US007942364B2

(12) United States Patent
Yu Chen

(10) Patent No.: US 7,942,364 B2
(45) **Date of Patent: *May 17, 2011**

(54) FILM PACKAGING APPLICATOR ADJUSTABLE

(76) Inventor: Hsiu-Man Yu Chen, Tan Tzu Township, Taichung County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/549,204

(22) Filed: Aug. 27, 2009

(65) Prior Publication Data

US 2011/0049287 A1 Mar. 3, 2011

(51) Int. Cl.
*B65H 75/24* (2006.01)

(52) U.S. Cl. ..... 242/578.2; 242/609.1; 242/613

(58) Field of Classification Search ..... 242/578, 242/578.1, 578.2, 607, 609, 609.1, 609.2, 242/609.3, 613, 118.5
See application file for complete search history.

(56) References Cited

U.S. PATENT DOCUMENTS

| | | | | |
|---|---|---|---|---|
| 1,098,479 | A * | 6/1914 | Clark et al. | 242/609 |
| 1,248,017 | A * | 11/1917 | Sande | 242/609.1 |
| 2,406,435 | A * | 8/1946 | Payne | 242/125.1 |
| 2,905,408 | A * | 9/1959 | Stetka et al. | 242/578.2 |
| 3,447,759 | A * | 6/1969 | Rau | 242/578.2 |
| 5,322,234 | A * | 6/1994 | Robert et al. | 242/596.7 |
| 6,676,069 | B1 * | 1/2004 | Davis | 242/609.1 |

* cited by examiner

*Primary Examiner* — William A Rivera
(74) *Attorney, Agent, or Firm* — Ming Chow; Sinorica, LLC

(57) ABSTRACT

A film packaging applicator adjustable includes a first tube and a second tube that join with each other. A guidance groove is formed axially on the first tube. Further, at least one side of the guidance groove, several equidistant hemispheric orientation slots that are formed in a radial direction are formed. A neck is formed at the orientation slot near the guidance groove. The second tube opposite to the guidance groove of first tube is formed with a hemispheric positioning block slipping from the guidance groove and then wedging into one orientation slot of the first tube. Thus, the applicator may be adjusted for a required length following the width of a film reel.

8 Claims, 6 Drawing Sheets

FILM PACKAGING APPLICATOR ADJUSTABLE

BACKGROUND OF THE INVENTION

1. Field of the Invention

This invention relates to a film packaging applicator adjustable.

2. Description of the Prior Art

Generally, to avoid an article that is being shipped from wobbling and dropping, a film packaging is used for achievement of the effect of fixing. In order to make the film easily spread, the film is rolled in the form of a reel into a film reel and a paper axis is provided in the axis of film reel for a user to spread the film reel with his or her hand directly passing through the paper axis of film reel or with a lever passing through the paper axis of film reel that is used as a central axis.

However, owing to the aspects of environmental protection and cost down that are considered in recent years, the paper axis of film reel is removed. Thus, the axis of film reel is formed without any support, so the user cannot make the film spread with his or her hand as the central axis; the user may still use the lever to make the film spread. However, the lever is not adjustable in length, when the film spreads, the film reel is subject to shifting to the right or to the left along the along the axis of lever to hinder the packaging from proceeding, and at the time of binding, the reel is also subject to idling, which does not make the film binding effective. Thus, it is apparent that developing the film packaging applicator rolling around the film reel without any paper axis is necessarily made.

Consequently, because of the technical defects of described above, the applicant keeps on carving unflaggingly through wholehearted experience and research to develop the present invention, which can effectively improve the defects described above.

SUMMARY OF THE INVENTION

A film packaging applicator adjustable according to the present invention essentially comprises a first tube and a second tube. A guidance groove is formed axially on the outside wall of first tube. One end of the guidance groove stretches to a combination end and a mouth is formed at its extremity; the other end stretches towards a wearing end. Further, at at least one side of the guidance groove, several equidistant orientation slots that are formed in a radial direction and communicate with the guidance groove are formed. The orientation slot is around in the form of hemisphere and a neck is formed at the orientation slot near the guidance groove. Next, a first stopper is formed outwards on the wearing end of the outer wall of first tube. The second tube is set around the first tube, the two ends of which are opposite to the first tube that defines a combination end and a wearing end. The inner wall of second tube that is near the combination end is opposite to the guidance groove of first tube that is formed with a hemispheric positioning block slipping from the guidance groove and then wedging into one orientation slot of the first tube so that the applicator may be formed in different lengths defined by adjusting the positioning block. Next, a second stopper is formed outwards on the wearing end of the outer wall of second tube. Thus, the applicator may be adjusted for a required length following the width of film reel provided without any paper axis, which avoids the film reel from shifting and idling when spreading and facilitates the user to package.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
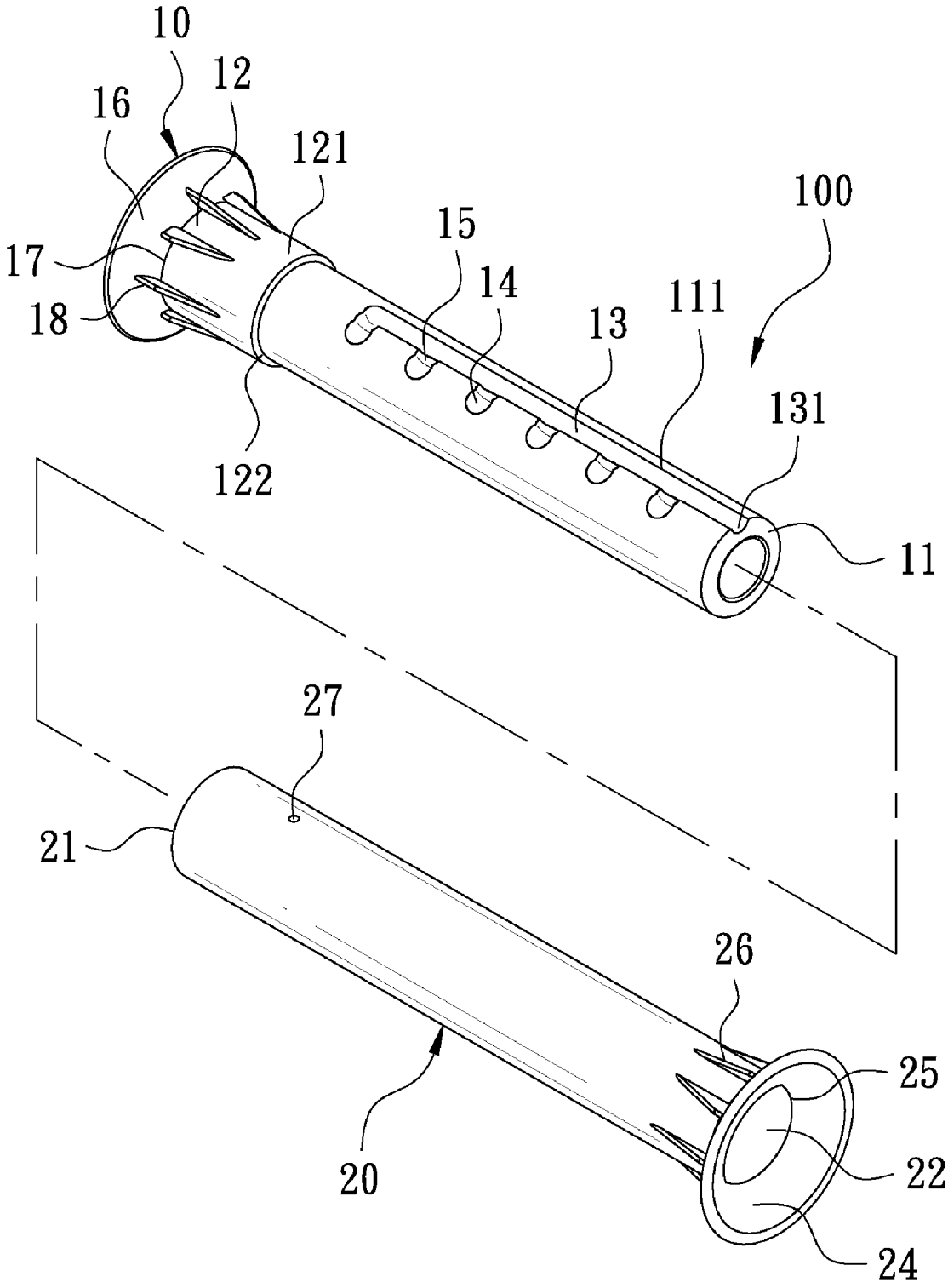
FIG. 1 is an exploded view of a preferred embodiment of the present invention.

With reference to FIG. 1 shown as an exploded view of a preferred embodiment of the present invention, an applicator 100 consists essentially of a first tube 10 and a second tube 20 that are joined with each other. The first tube 10 and the second tube 20 are made of plastics.

Figure 2:
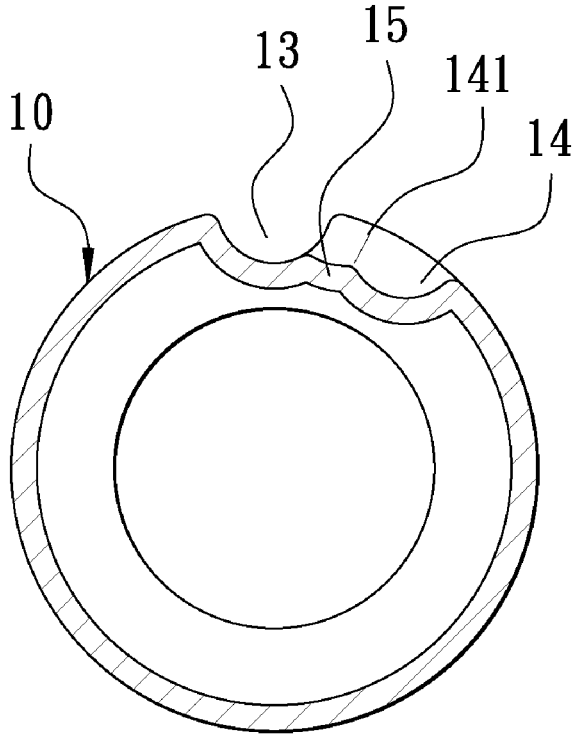
FIG. 2 is a sectional view of a first tube according to the present invention.
Figure 3:
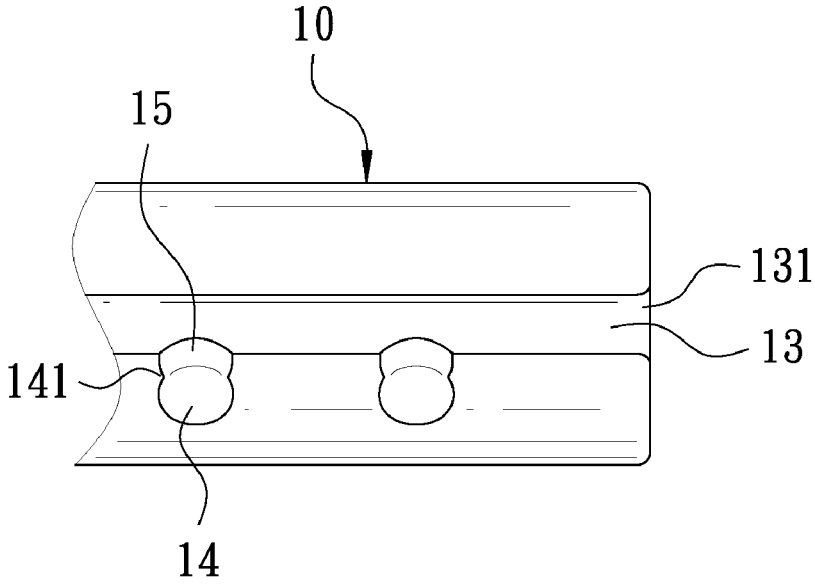
FIG. 3 is a sectional enlarged view of a positioning slot according to the present invention.
Figure 8:
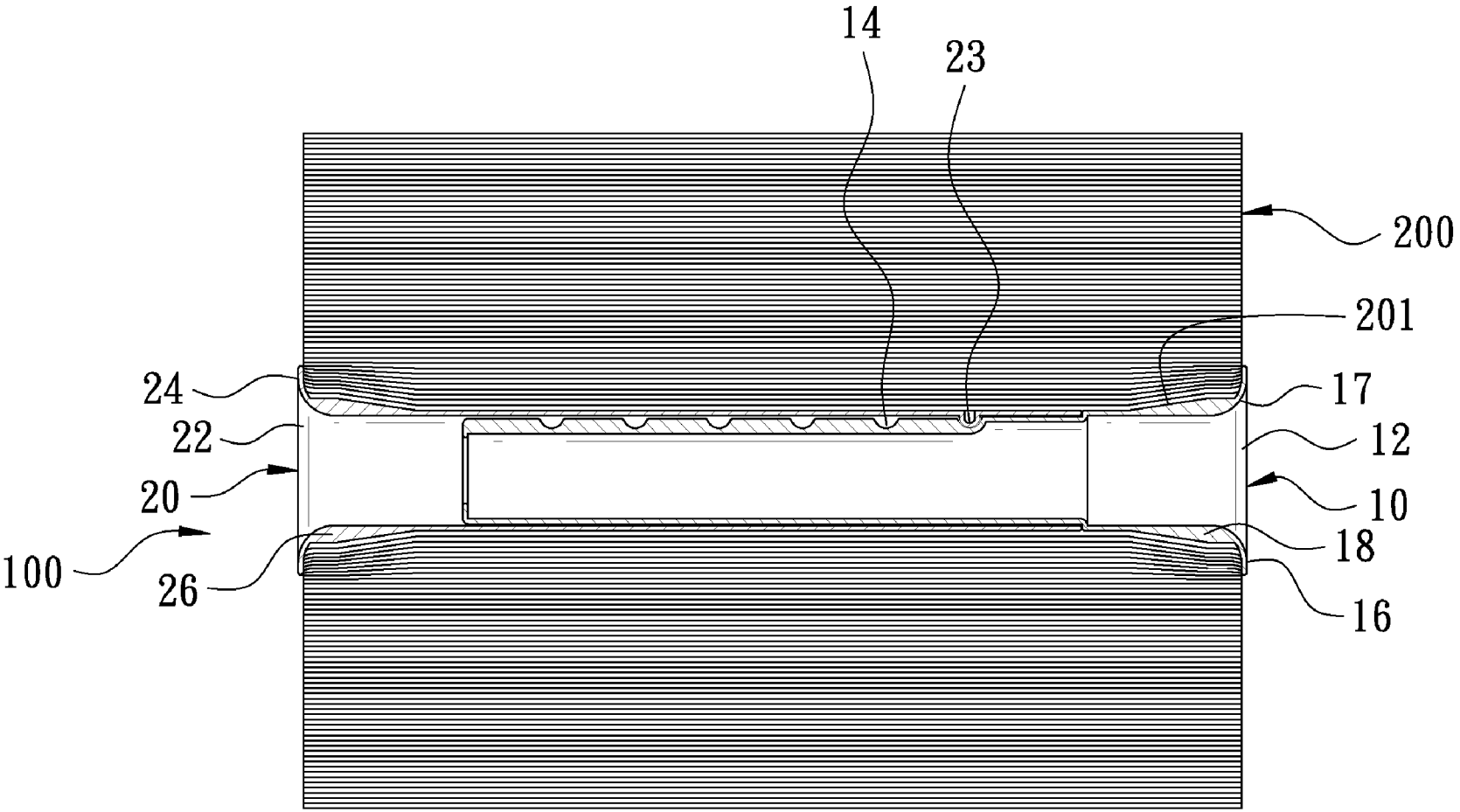
FIG. 8 is a sectional assembly view of the service state of the present invention.

The two ends of first tube 10 define respectively a combination end 11 and a wearing end 12. The first tube 10 may be divided into a joint section 111 near the combination end 11, and a wearing section 121 near the wearing end 12. The outer tube diameter of wearing section 121 is larger than the joint section 111, so a shoulder portion 122 is formed at a connection between the wearing section 121 and the joint section 111 to stop a front end of the second tube 20 when the first tube 10 joins with the second tube 20. Further, the outer tube diameter of wearing section 121 is equal to the second tube 20 for forming the applicator 100 of identical tube diameter. Next, a guidance groove 13 is formed axially on the outside wall of first tube 10, in which a bottom side formed in the guidance groove 13 is in the form of an arc, one end of the guidance groove 13 stretches to the combination end 11 and a mouth 131 is formed at its extremity, and the other end stretches towards the wearing end 12. Next, at one side of the guidance groove 13, six equidistant orientation slots 14 that are formed in a radial direction and communicate with the guidance groove 13 are formed. With reference to FIGS. 2 and 3, the orientation slot 14 is around in the form of hemisphere, a neck 141 is formed at the orientation slot 14 near the guidance groove 13, and a convex portion 15 is formed between the necks 141. Next, a first stopper 16 is formed outwards on the wearing end 12 of the outer wall of first tube 10. In this embodiment, at the wearing end 12 of first tube 10, an annular flange is formed outwards in a radial direction. A joint 17 between the first stopper portion 16 and the first tube 10, as shown in FIG. 8, is in the form of arc expanding by degree, which makes the wearing end 12 of first tube 10 to be in the form of a horn. Besides, several ribs 18 are outwards formed around the joint 17 between the first stopper portion 16 and the first tube 10. The rib 18 heightens by degree axially toward the first stopper portion 16.

Figure 4:
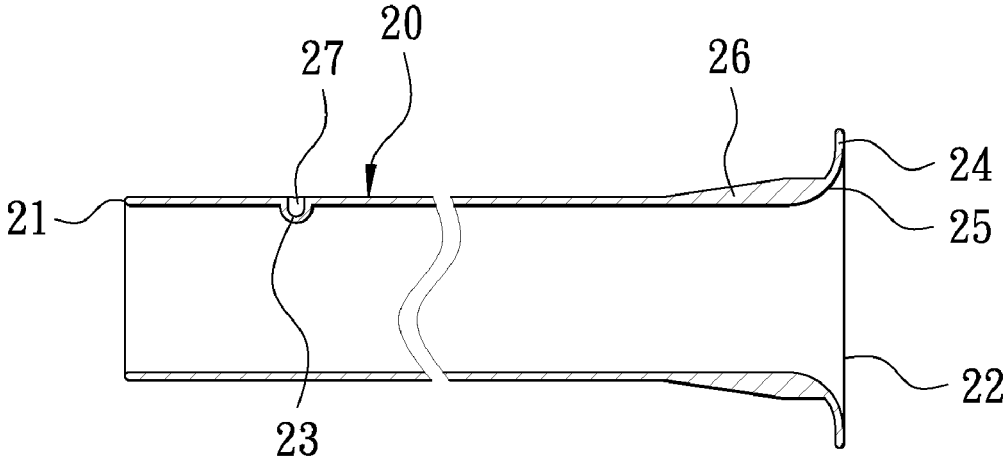
FIG. 4 is a sectional view of a second tube according to the present invention.

The two ends of the second tube 20 opposite to the first tube 10 defines a combination end 21 and a wearing end 22. With reference to FIG. 4, the inner wall of second tube 20 that is near the combination end 21 is opposite to the guidance groove 13 of first tube 10 that is formed with a hemispheric positioning block 23 slipping from the guidance groove 13 and then wedging into one orientation slot 14 of the first tube 10 so that the applicator 100 may be formed in different lengths defined by adjusting the hemispheric positioning block 23. Further, a second stopper 24 is formed outwards in a radial direction on the wearing end 22 of the outer wall of second tube 20. In this embodiment, at the wearing end 22 of second tube 20, an annular flange is formed in a radial direction. A joint 25 between the second stopper portion 24 and the second tube 20 is in the form of arc expanding by degree, which makes the wearing end 22 of second tube 20 to be in the form of a horn. Besides, several ribs 26 are outwards formed around the joint 25 between the second stopper portion 24 and the second tube 20. The rib 26 heightens by degree axially toward the second stopper portion 24. Next, a concave 27 is formed at the outer wall of second tube 20 opposite to the hemispheric positioning block 23.

Figure 5:
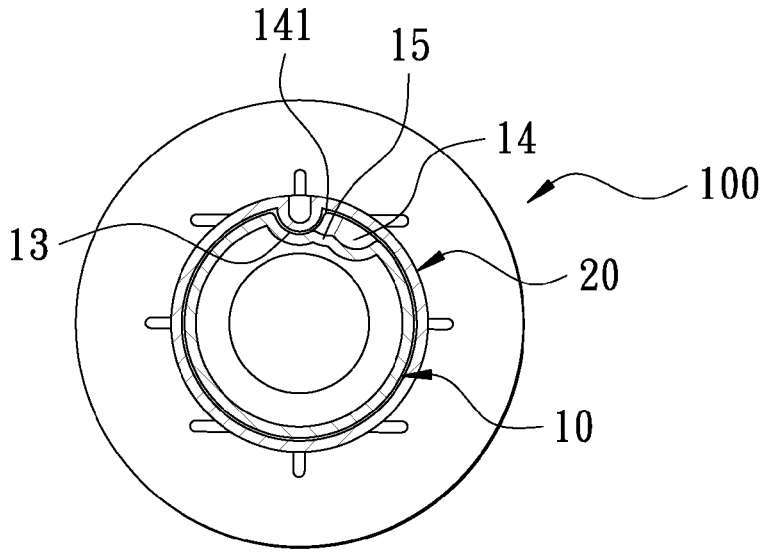
FIG. 5 is a schematic view illustrating the positioning block according to the present invention that has not slipped into the positioning slot.
Figure 6:
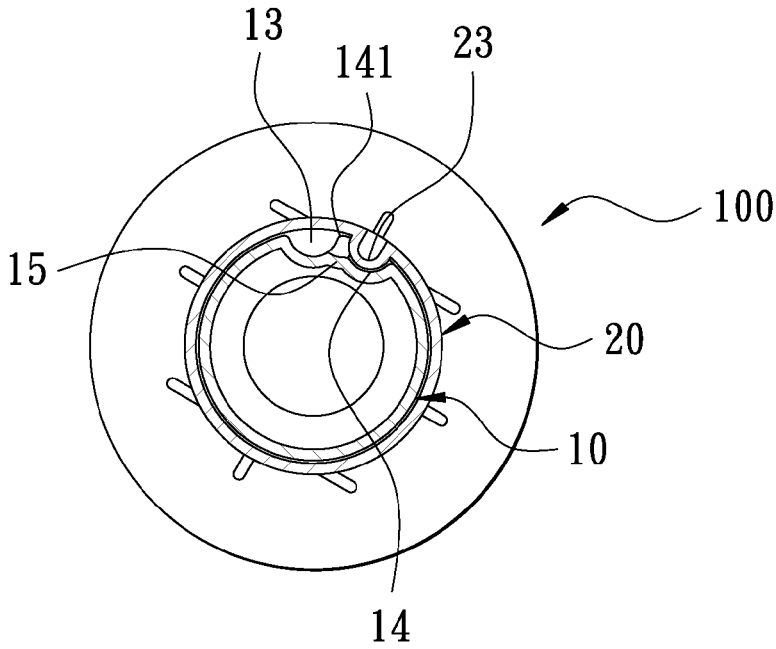
FIG. 6 is a schematic view illustrating the positioning block according to the present invention that slips into the positioning slot and is fixed into the slot.
Figure 7:
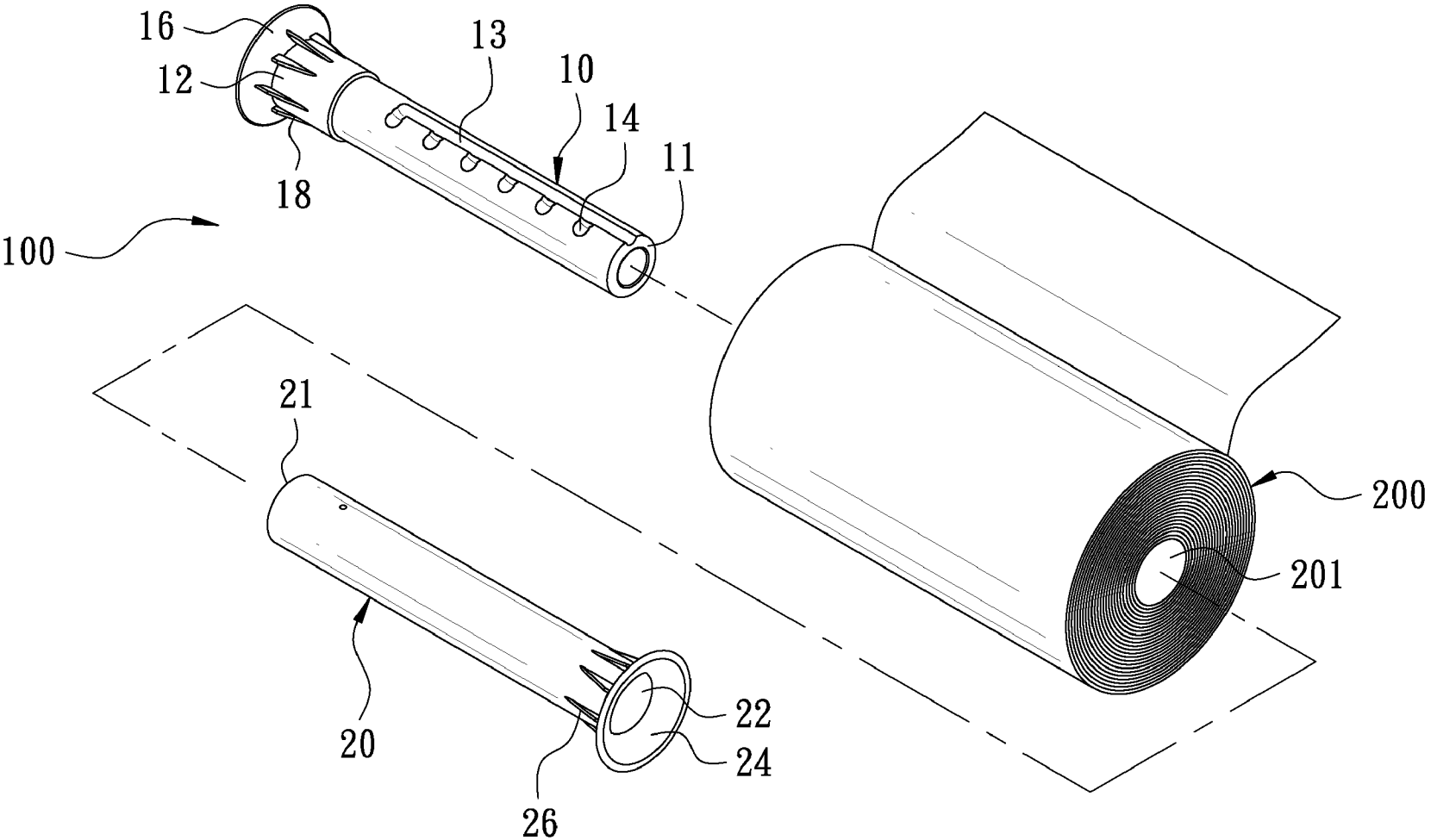
FIG. 7 is an exploded view of a service state of the present invention.

With reference to FIGS. 5 and 6 shown as a schematic view illustrating a service state of the present invention, to connect the first tube 10 with the second tube 20, the hemispheric positioning block 23 of second tube 20 is firstly aligned to the guidance groove 13 of first tube 10 and slips into the guidance groove 13 from the mouth 131 of guidance groove 13; then, the first tube 10 and the second tube 20 are rotated in a reverse direction to make the hemispheric positioning block 23 of second tube 20 push open the neck 141 of orientation slot 14 and slip into the orientation slot 14 for combination of the first tube 10 with the second tube 20, and the neck 141 and the convex portion 15 are used for achievement of the stopping effect that avoids the hemispheric positioning block 23 from slipping away from the orientation slot 14; thus, with reference to FIGS. 7 and 8 shown as a schematic view and a sectional view that illustrate the service state of the present invention, in the service state, the combination end 11 of first tube 10 and the combination end 21 of second tube 20 that are provided in the applicator 100 are made to pass separately through the two sides of axis 201 of a film reel 200 without any paper axis, the first stopper portion 16 of first tube 10 and the second stopper portion 24 of second tube 20 are separately fitted tightly to the two sides of the film reel 200, and the first tube 10 and the second tube 20 are rotated in a reverse direction. Next, a user may make the film spread with a finger as a central axis passing through the wearing end 12 of first tube 10 and the wearing end 22 of second tube 20. The wearing end 12 of first tube 10 and the wearing end 22 of second tube 20 are in the form of the horn so that the user's finger may be protected from being cut during film spreading. Further, with reference to FIG. 8, the rib 18 around the wearing end 12 of first tube 10, and the rib 26 around the wearing end 22 of second tube 20 are used to push open the film reel 200, which does not make the film reel 200 idle at the time of binding.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A film packaging applicator adjustable, comprising:

a first tube comprises a first combination end and a first wearing end, in which a guidance groove is formed axially on the outside wall of first tube, one end of the guidance groove stretches to the first combination end and a mouth is formed at its extremity and the other end of the guidance groove stretches towards the first wearing end, at least one side of the guidance groove, several equidistant orientation slots that are formed in a radial direction and communicate with the guidance groove are formed, the orientation slots are around in the form of a hemisphere and a neck is formed at each of the orientation slots near the guidance groove, and a first stopper is formed outwards on the first wearing end of the outer wall of first tube;

a second tube comprises a second combination end and a second wearing end;

the second tube being set around the first tube;

the second combination end and the second wearing end being opposite to the first combination end and the first wearing end;

an inner wall of second tube that is near the second combination end is opposite to the guidance groove of the first tube that is formed with a hemispheric positioning block slipping from the guidance groove and then wedging into one orientation slot of the first tube so that the applicator may be formed in different lengths defined by adjusting the hemispheric positioning block, and a second stopper is formed outwards on the second wearing end of the outer wall of the second tube; and several ribs are outwards formed around the joint between the first stopper portion and the first tube and the rib heightens by degree axially toward the first stopper portion.

2. The film packaging applicator adjustable according to claim 1, wherein the first tube is divided into a joint section near the first combination end, and a wearing section near the first wearing end, the outer tube diameter of the wearing section is larger than that of the joint section, so a shoulder portion is formed at a joint between the wearing section and the joint section, the outer tube diameter of wearing section is equal to that of the second tube.

3. The film packaging applicator adjustable according to claim 1, wherein the first stopper is an annular flange formed outwards in a radial direction from the first wearing end of first tube.

4. The film packaging applicator adjustable according to claim 1, wherein a joint between the first stopper portion and the first tube is in the form of an arc expanding by degree, which makes the first wearing end of first tube to be in the form of a horn.

5. The film packaging applicator adjustable according to claim 1, wherein the second stopper is an annular flange formed outwards in a radial direction from the second wearing end of the second tube.

6. The film packaging applicator adjustable according to claim 1, wherein several ribs are outwards formed around the joint between the second stopper portion and the second tube and the rib heightens by degree axially toward the second stopper portion.

7. The film packaging applicator adjustable according to claim 1, wherein a joint between the second stopper portion and the second tube is in the form of an arc expanding by degree, which makes the second wearing end of the second tube to be in the form of a horn.

8. The film packaging applicator adjustable according to claim 1, wherein a concave is formed at the outer wall of the second tube opposite to the positioning block.

* * * * *